United States Patent [19]

Eynck

[11] 4,399,526

[45] Aug. 16, 1983

[54] ACOUSTIC BAFFLE FOR HIGH-PRESSURE SERVICE, MODULAR DESIGN

[75] Inventor: John J. Eynck, Arnold, Md.

[73] Assignee: The United States of America as represented by the Secretary of the Navy, Washington, D.C.

[21] Appl. No.: 228,848

[22] Filed: Jan. 27, 1981

[51] Int. Cl.[3] ..... H04R 17/00

[52] U.S. Cl. ..... 367/149; 181/292; 310/337; 367/151; 367/152; 367/153; 367/162; 367/173; 367/176

[58] Field of Search ..... 367/141, 149, 151, 152, 367/153, 155–157, 162, 165, 167, 172, 173, 176; 310/321, 326, 335, 337; 181/175, 286, 288, 290, 292; 248/559, 562

[56] References Cited

U.S. PATENT DOCUMENTS

| | | | |
|---|---|---|---|
| 2,754,925 | 7/1956 | Burke . | |
| 2,768,364 | 10/1956 | Camp | 367/155 |
| 3,087,574 | 4/1963 | Watter . | |
| 3,177,970 | 4/1965 | Boschi | 181/290 |
| 3,424,270 | 1/1969 | Hartman et al. | 181/290 |
| 3,601,228 | 8/1971 | Nashif . | |
| 3,737,004 | 6/1973 | Higgs . | |
| 3,907,062 | 9/1975 | Brigham | 367/151 |
| 4,177,876 | 12/1979 | Pujolle . | |

FOREIGN PATENT DOCUMENTS

| | | | |
|---|---|---|---|
| 359867 | 3/1962 | Switzerland | 181/292 |

*Primary Examiner*—Harold J. Tudor
*Attorney, Agent, or Firm*—R. F. Beers; L. A. Marsh

[57] ABSTRACT

An acoustic array for use at high hydrostatic pressures comprises an acoustic isolation baffle positioned adjacent to the hull; an intermediate acoustic conditioning module supported over the isolation baffle; and an outer layer containing a plurality of hydrophone units. The acoustic isolation baffle comprises alternating layers of rigid and compliant materials bonded together in sandwich fashion, wherein the compliant layer is provided with a regular pattern of air cells. In adjoining compliant layers the pattern of air cells is translated relative to each other so that the load bearing walls of one compliant layer overlap the open cell regions of the adjacent compliant layer with only a rigid layer disposed therebetween. The acoustic conditioning module comprises spaced coverplates with spacer elements extending therebetween to form a plurality of chambers which contain viscoelastic damping elements bonded to the outer coverplate.

7 Claims, 7 Drawing Figures

ACOUSTIC BAFFLE FOR HIGH-PRESSURE SERVICE, MODULAR DESIGN

BACKGROUND OF THE INVENTION

The present invention generally relates to noise reduction systems and, more particularly, to acoustic arrays applied on the underwater surfaces of ships.

Modern sonar arrays used on the exterior surfaces of submarine hulls are commonly formed of three distinct layers connected to each other in sandwich fashion. The three layers comprise a sound isolation baffle or skirt baffle attached to the exterior surface of the vessel; an intermediate sound conditioning layer secured over the isolation baffle; and an outer layer containing a plurality of hydrophone units.

The sound isolation baffles are used to eliminate or reduce shipboard noise which would otherwise adversely affect the performance of the hydrophone units. The sound isolation baffles in use today attenuate, absorb and reflect shipboard noise by means which may include:

a. acoustic reflecting layers containing a plurality of hollow, compliant tubes;
b. gas and/or air filled multicellular materials such as elastomeric foams, wherein the size, number, and orientation of the microcells are critical factors affecting optimum performance of the baffle;
c. composite materials such as "Corprene", wherein cork particles are embedded in a neoprene matrix; and
d. elastomeric materials containing flattened steel tubes which are designed to resonate in their thickness mode at a preselected frequency.

However, the baffle systems outlined above suffer from various disadvantages. For example, the compliant tubes lose their efficiency when hydrostatic pressures cause the tube walls to collapse, and increasing the rigidity of the tubes to prevent such collapse of the tubes normally results in diminished acoustic performance. Further, for example, gas-filled multicellular materials normally exhibit random wall thickness and very high shape factors (ratio of the area on one face of the loaded compression element to the free lateral area). This relationship, which also applies to materials incorporating cork particles and air interstices, results in diminished performance at lower frequencies and higher pressures. Furthermore, baffles which utilize flattened steel tubes are acoustically effective in their design frequency range, but are prone to fatigue cracking and they become unduly heavy when designed for low frequency applications.

Baffle systems which primarily function as sound-absoring means also have operational limitations. For example, the acoustic impedance of sound absorbing baffles must match the acoustic impedance of the water, otherwise the sound energy will not enter the sound absorbing baffles and dissipate therein. Additionally, elastomeric materials in sound absorbing baffles must possess sufficient compliance so that the elastomeric materials will exhibit maximum motion at the desired frequencies to convert the incident sound energy into heat through hysteresis of the elastomer. When the hydrostatic pressures on the acoustic isolation baffles are increased, for example, the resultant increased stress in the elastomer generally results in a shift of its optimum sound absorption characteristics to higher sound frequencies and also results in an impedance mismatch with the water so that the amount of sound entering the baffle is reduced. Further, for low frequency applications this type of baffle is prohibitively thick.

The intermediate element of an acoustic array, the signal conditioning plate, ideally provides a high insertion loss to the incoming signals, with a minimum phase shift, and the conditioning plate relies heavily on the skirt baffle for pressure release. One form of conditioning plate comprises a plurality of aluminum plates supported in spaced relationship by steel springs and sealed together along the plate edges by a viscoelastic binder. Another type of conditioning plate consists of elastomeric elements encased within compartments in a rigid module to provide one-quarter wavelength resonance response to incident acoustic signals.

The outer layer of the acoustic array includes hydrophone elements embedded in a viscoelastic medium. Preferably, the viscoelastic medium has an impedance equivalent to the impedance of seawater in order to optimize acoustic receptivity.

SUMMARY OF THE INVENTION

The abovementioned drawbacks with some of the prior art are overcome by providing a lightweight, compact hydrophone array capable of high efficiency over a broad range of depths and incident acoustic frequencies. This is generally accomplished by constructing a sonar array having an acoustic skirt baffle positioned adjacent to the hull; an intermediate acoustic conditioning module supported over the skirt baffle; and an outer layer containing a plurality of hydrophone units.

The acoustic isolation baffle comprises alternate layers of rigid and compliant materials bonded together in sandwich fashion. The rigid materials are preferably formed of fiber or glass reinforced composite materials, and the compliant layers are preferably formed of an elastomeric material with a regular pattern of air cells formed therein. In adjoining compliant layers, the pattern of air cells is translated relative to each other so that the load bearing walls of one compliant layer overlap the open cell regions of the adjacent compliant layers with only a rigid layer disposed therebetween.

The acoustic conditioning module comprises inner and outer spaced, planar coverplates; spacer elements extending between the coverplates to form a plurality of closed chambers therebetween; and tuned damping elements positioned in the chambers and secured to the outer coverplate. Preferably, the tuned damping elements include an elastomeric mass or damping layer, which is secured to the outer coverplate, and an inertial tuning mass, such as a flat plate, attached to the damping layer. The chambers are sealed from the surrounding environment so that the characteristic impedance and efficiency of the damping elements is independent of variations in the hydrostatic pressure.

The outer layer containing the hydrophone units has an impedance which is equivalent to the surrounding acquatic environment to optimize acoustic receptivity.

Accordingly, it is an object of this invention to provide an improved sonar array of a simple, efficient design which is inexpensive to construct and maintain.

Another object of the invention is to provide a compact, lightweight sonar array of sufficient strength and rigidity so that hydrodynamic drag and other forces do not appreciably deform or damage the array, but where the array retains the requisite flexibility for mounting the array on curved surfaces.

A further object of this invention is to provide an underwater acoustic array which has high efficiency throughout a broad range of incident acoustic frequencies and which is designed for use at higher hydrostatic pressures than that at which previous acoustic arrays could function successfully.

Yet another object of this invention is to provide an improved acoustic skirt baffle for reducing the transmission of shipboard noise by providing an improved acoustic skirt baffle having hydrostatically compressed viscoelastic layers disposed between rigid layers.

BRIEF DESCRIPTION OF THE DRAWINGS

The novel features which are believed to be characteristic of this invention are set forth with particularity in the appended claims. The invention itself, however, both as to its organization and the method disclosed herein, together with further objects and advantages thereof, may be best understood by reference to the following description taken in conjunction with the accompanying drawings, in which:

DETAILED DESCRIPTION OF THE INVENTION

Figure 1:
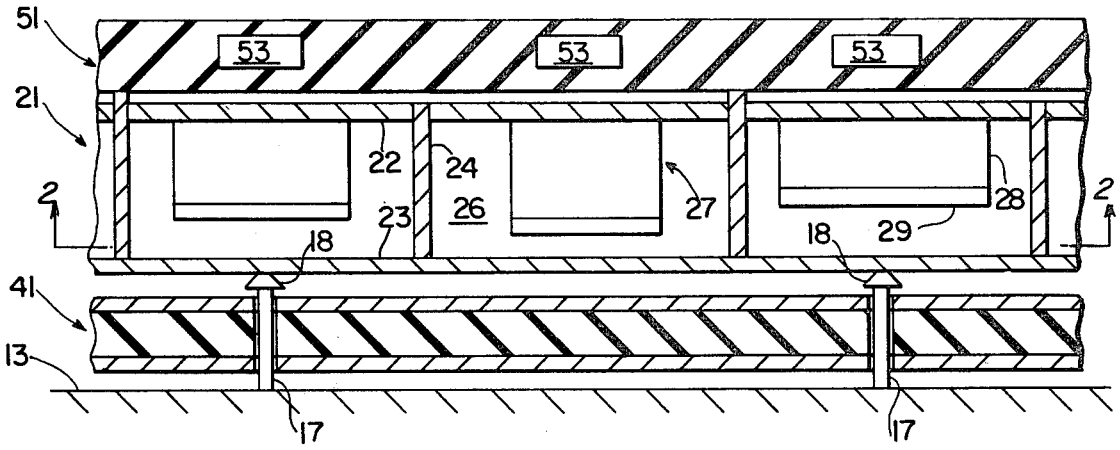
FIG. 1 is a sectional view of the sonar array of the present invention.

Referring now to FIG. 1 there is shown a multilayered sonar array which includes an acoustic skirt baffle 41 positioned adjacent to the hull 13 of the vessel, an acoustic conditioning module 21 supported over the skirt baffle 41, and a layer of hydrophones 53 superimposed over the conditioning module 21 in contiguous relationship therewith.

The conditioning module 21 provides a mass reactance which coherently reflects the incoming signals so that the reflected acoustic signals reinforce the incident acoustic signals. For example, when a planar beam of acoustic waves is reflected from an air "backed" conditioning module, a stationary system of waves is obtained which gives rise to pressure and velocity fields that are offset (out of phase) from each other by $\lambda/4$, where $\lambda$ is the wavelength of an acoustic signal. Thus, the stationary pressure waves have a nodal point or a minimum value at the interface surface of the air backed reflector and a maximum value at the surface of the conditioning module. In order to obtain maximum hydrophone sensitivity, the hydrophones 53 should be placed where the peak pressure field occurs. It follows that the sensitivity of hydrophones 53 positioned at a distance $(\lambda_1/4)$ from a reflecting surface, where $\lambda$ represents the wavelength of an acoustic signal, reaches a maximum value only at a predetermined frequency $(f_1)$, where the velocity $V_1=\lambda_1 f_1$. The sensitivity decreases slightly as the frequency of the incoming acoustic signals deviates from the particular frequency $f_1$ by $\pm\frac{1}{3}$ octave. Thus, for acoustic signals of a known narrow frequency range, selection and use of a hydrophone having a particular center frequency is usually not a problem. However, in actuality, the incident acoustic signals may cover a broad spectrum so that a plurality of hydrophone units of different particular center frequencies may be required to adequately detect the various acoustic signals. The center frequency (fc) is defined as the principal, mid-band frequency of a predetermined frequency range, and a hydrophone is normally designated with a particular center frequency (fc) with it being understood that the hydrophone has optimum performance throughout a particular range of acoustic frequencies.

The acoustic conditioning module 21 and skirt baffle 41 of the array 15 in FIG. 1 provide a means for efficiently detecting incident acoustic signals over a wide frequency range. This improved sensitivity and efficiency for a broad range of frequencies is accomplished by providing the acoustic module 21 with a plurality of tuned, viscoelastic damping elements 27, as more particularly illustrated in FIGS. 2 and 3, and by providing skirt baffle 41 with a plurality of air cells as shown in FIGS. 4–7.

Figure 2:
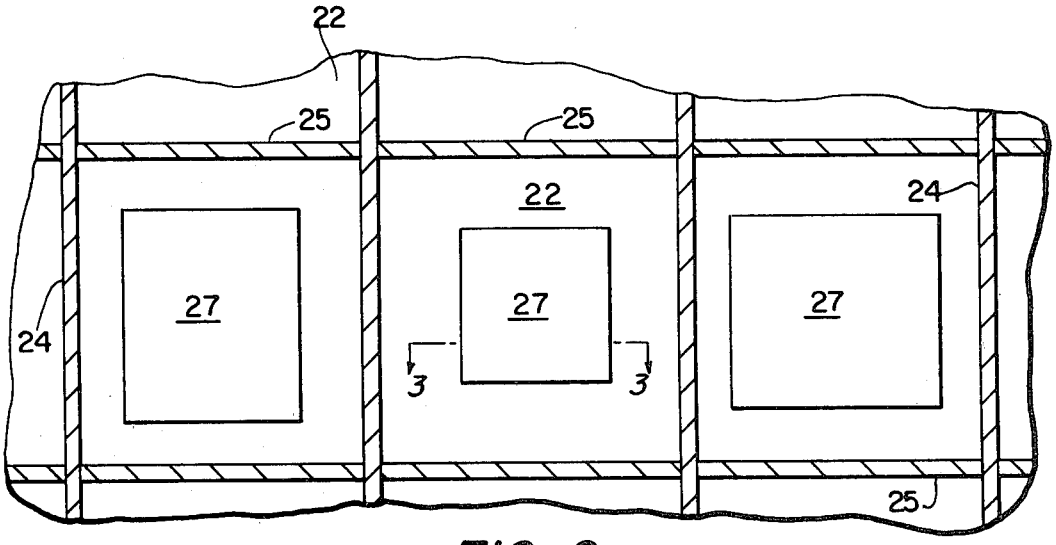
FIG. 2 is a plan view of the sonar array taken generally along line 2—2 of FIG. 1.
Figure 3:
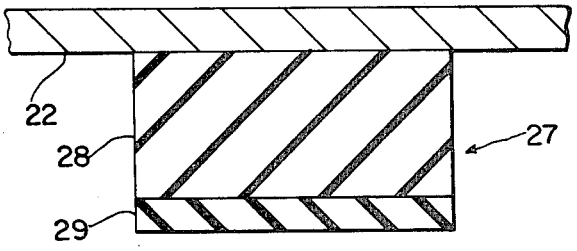
FIG. 3 is a cross-sectional view of the damping elements taken along line 3—3 of FIG. 2.

The acoustic module 21 includes spaced forward and rear coverplates 22, 23, as shown in FIG. 1, which form respective interfaces with the hydrophone layer 51 and the skirt baffle 41. Transverse and longitudinal spacer elements 24, 25 intersect to define a grid which extends between the coverplates 22, 23 to form a plurality of closed cells 26 which are isolated from the surrounding environment. The particular arrangement of coverplates 22, 23 and spacer elements 24, 25 provides the acoustic module 21 with sufficient strength and rigidity so that hydrostatic forces do not appreciably deform and damage the array, but where the array retains the flexibility needed for mounting the module on slightly curved surfaces. The damping elements 27, which preferably have different dimensions for accomodating different incident center frequencies (fc), are disposed in the closed cells 26 and bonded to the interior surface of the outer coverplate 22 so that the acoustic signals reflected from the damping elements are coherent with and reinforce the incident signals at the hydrophone units 53. While the closed cells 26 in FIG. 2 are square shaped, other compatible cell configurations include cylindrical, rectangular and conical configurations. For example, cylindrical air cells may be constructed of cylindrical containers secured between spaced coverplate elements.

Each damping element 27, which is designed for an incident acoustic signal of a particular center frequency $(f_c)$, includes an elastomeric mass or damping layer 28 that has a thickness of approximately $\lambda_c/4$, where $\lambda_c$ represents the wavelength of the incident acoustic signal having a frequency (fc) and velocity (Vc) in the damping layer 28. Each damping element 27 also includes an inertial tuning mass 29 of steel or other materials, such as viscoelastic elements, which are bonded to the elastomeric layer 28. Preferably, the elastomeric layer 28 is selected of an appropriate material so that the modulus (E) of the material is equivalent to $16d^2f^2\rho$, where:

d is the thickness of the elastomeric layer;

f is the center frequency (fc) of a predetermined range of incident acoustic signals; and $\rho$ is the density of the elastomeric layer.

In addition, the damping material 28 must possess sufficient "loss" characteristics to attenuate half-wavelength resonances while at the same time being insensitive to moderate temperature variations.

Examples of suitable elastomeric materials 28 include nitrile rubbers such as butadiene-acrylonitrile based compositions wherein the content, by weight percent, of the acrylonitrile is between about 20% to about 47% and preferably between about 30% to about 38% of the composition. Such rubber materials are commercially available as Hycar 1014 and 1203 manufactured by B. F. Goodrich Co. and Paracril BLT and CLT as manufactured by Uniroyal, Inc. Particular examples of butadiene-acrylonitrile compositions are shown in the tables that follow. Other elastomer elements, when properly compounded, include natural rubber; propylene oxide rubber; epichlorohydrin rubber; butyl rubber; chlorobutyl and bromodutyl rubbers; ethylene acrylic rubber; and polynorbornenes. Somewhat less desirable compositions include neoprene; fluorocarbon; fluorosilicones; polyphosphazenes; polybutadienes; chlorosulfonated polyethylenes; styrene-butadiene rubber; and silicones.

| | NITRILE RUBBER FORMULATIONS | | | | | | |
|---|---|---|---|---|---|---|---|
| Material | 1 | 2 | 3 | 4 | 5 | 6 | 7 |
| PARACRIL CLT | 100 | 100 | 100 | 100 | 100 | 100 | 100 |
| PHILBLACK N-550 | 70 | | | 20 | 20 | | |
| THERMAX | | 80 | 120 | | | | |
| IRON OXIDE | | | | 100 | 200 | | |
| QUSO WR 82 | | | | | | 30 | 50 |
| STEARIC ACID | 1 | 1 | 1 | 1 | 1 | 1 | 1 |
| PROTOX 166 | 5 | 5 | 5 | 5 | 5 | 5 | 5 |
| FYROL CEF | 5 | 5 | 5 | 5 | 5 | 5 | 5 |
| OCTAMINE | 1 | 1 | 1 | 1 | 1 | 1 | 1 |
| THIONEX | 0.5 | 0.5 | 0.5 | 0.5 | 0.5 | 0.5 | 0.5 |
| SULFUR | 1.5 | 1.5 | 1.5 | 1.5 | 1.5 | 1.5 | 1.5 |
| Total Parts | 184 | 194 | 234 | 234 | 334 | 144 | 164 |

| | NITRILE RUBBER FORMULATIONS | | | | | | |
|---|---|---|---|---|---|---|---|
| Material | 8 | 9 | 10 | 11 | 12 | 13 | 14 |
| PARACRIL CLT | 100 | 100 | 100 | 100 | 100 | 100 | 100 |
| PHILBLACK N-500 | 50 | 50 | 50 | 50 | 50 | 50 | 50 |
| PROTOX 166 | 5 | 5 | 5 | 5 | 5 | 5 | 5 |
| OCTAMINE | 2 | 2 | 2 | 2 | 2 | 2 | 2 |
| SARET 500 | | 5 | 10 | 20 | | | |
| SARET 515 | | | | | 5 | 10 | 20 |
| Di CUP 40 PEROXIDE | 4 | 4 | 4 | 4 | 4 | 4 | 4 |
| Total Parts | 161 | 166 | 171 | 181 | 166 | 171 | 181 |

DESCRIPTION OF VARIOUS COMPOUNDING MATERIALS

Elastomers:

Hycar 1034-60—acrylonitrile content 21%

Hycar 1203—70/30 blend of butadiene-acrylonitrile/polyvinyl chloride

Paracril BLT—acrylonitrile content 32%

Paracril CLT—acrylonitrile content 38%

Vulcanizing Agents—Peroxides:

Di Cup 40—Hercules, dicumyl peroxide, sp. gr. 1.607, peroxide content 39.5–41%

Saret 500+515-Sartomer, acrylic crosslinking agent, liquid polymerisable monomer, sp. gr. 1.08, B.p. 200° C.

Vul-Cup 40 KE—Hercules, α-α'-bis(t-butylperoxyl) diisopropylbenzene, sp. gr. 1.03, peroxide content 96–100%

Sulfur (Rubbermakers or Tire 21-12 MC-TP) vulcanizing agent, sp. gr. 2.07

Carbon Blacks:

Philblack N-330—Phillips Chemical, HAF, average particle size 30 mμ, surface area 81 $m^2/g$ Philblack N-358—Philips Chemical, SPF, averaged particle size 25 mμ, surface area 87 $m^2/g$ Regal 99 (n-440)—Cabot, FF, average particle size 43 mμ, surface area 60 $m^2/g$ Philblack N-550—Phillips Chemical, FEF, average particle size 41 mμ, surface area 43 $m^2/g$ Thermax—RT Vanderbilt, MT, average particle size 320–472 mμ, surface area 8.2 $m^2/g$, density $kg/m^3$ Non-Black Fillers:

Andrez 8000AE, Anderson, Polystyrene resin

Hil-Sil 223-Harwick Chemical, precipitated, hydrated silica, sp. gr. 2.0, ultimate particle size 0.022 micron Iron Oxide—Black iron oxide, painter's grade Quso WR 82-Philadelphia Resins, Surface-treated silica pigment Titanium Dioxide-Whitener, medium grade Other Compounds:

Thionex-accelerator, for controlling the vulcanization

Fyrol CEF—plasticizer, for softing the compounds

Octamine—anti-oxidant, prevents oxidation reactions

Protox 166—activator, it reacts with the stearic acid to form a zinx stearate, which reacts with the curing agent. In general, the viscoelastic properties of the rubbers, and, consequently, the attenuation properties can be manipulated by varying the composition of the rubber, the type and concentration of the fillers, and the type and concentration of the vulcanizing agent. For example, in rubber-based composites the modulus (E) generally increases and the "loss" characteristics decrease with increasing concentrations of carbon black. Also the modulus (E) of the material generally increases for a decrease in the particle size or an increase in the surface area of the carbon black. The modulus (E) of the composition is also often increased with increasing concentrations of non-black filler such as iron oxide; hydrated silica; titanium oxide; silane-treated silica; as well as by increasing peroxide vulcanizing agents.

The utilization of an air backed elastomeric layer 28 as a one-quarter wavelength reflector behind the hydrophone is further enhanced by using the inertial fine tuning mass or tuning plate 29. The fine tuning of the elastomeric elements 27 for particular acoustic frequencies is achieved by selecting a tuning plate 29 of appropriate proportions, as described by the following mathematical expression:

$$\frac{Z_{in} = Z_s(Z_s + {}^{i}Z_r \tanh\gamma_r L_r)}{Z_r + iZ_s \tanh\gamma_r L_r}$$

where $Z_{in}$=the input impedance of elastomeric layer or "spring" element 28, backed by inertial mass 29 that terminates at an air backed interface; $Z_s = i\omega m$=the impedance of inertial mass 29; $i=\sqrt{-1}$; $Z_r$=the characteristic impedance of elastomeric layer or "spring" element 28; $\gamma$=the complex propagation constant for layer 28; $L_r$=the length (thickness) of layer 28; $\omega$=the circular frequency $2\pi f$; and m=the mass per unit area of inertial mass 29. If the fine tuning element or tuning plate 29 is constructed of a viscoelastic material ($Z_v$), then $Z_s=Z_v \tan h\ \gamma_v L_v$, where the quantities having subscripts "v" correspond to those quantities having the subscript "r" in the above equation. By using an elastomeric element 28, which has a thickness of $\gamma_c/4$ for a particular center frequency $f_c$, and tuning plate 29, the hyperbolic tangent function increases to maximum values and the input impedance increases accordingly, The air contained in the closed cells 26 provides a pressure release for the elastomeric mass or spring element 28 so that the layer resonates in its Young's modulus fashion. The air contained in the closed cells 26 also provides the conditioning module 21 with a buoyancy factor so that the conditioning module 21 can be made neutrally buoyant at a predetermined operating depth.

Means for supporting the conditioning module 21 from the hull 13 of the vessel include a plurality of spaced struts 17 secured to the hull 13 and connected to the conditioning module 21. Vibration isolation elements 18 are provided at the joint between the struts 17 and the conditioning module 21 for reducing vibrations transmitted therebetween.

Figure 4:
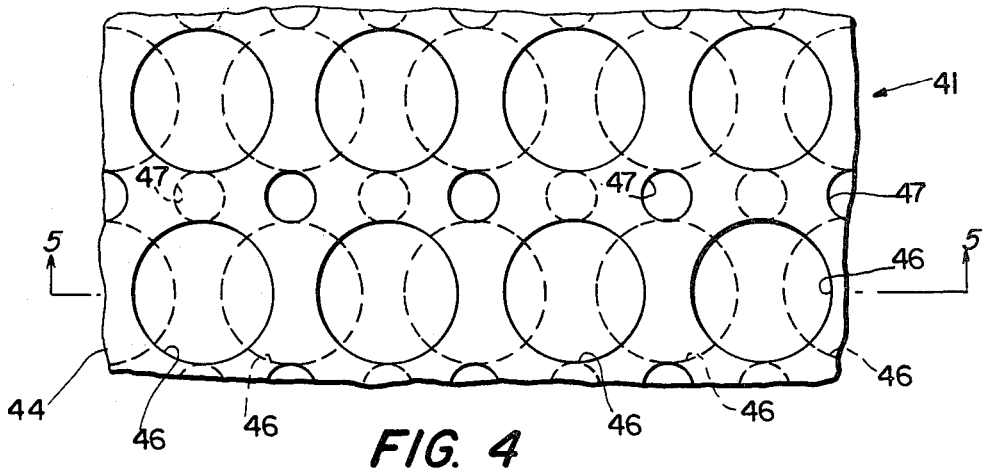
FIG. 4 is a plan view of an acoustic skirt baffle having cylindrical air cells.
Figure 5:
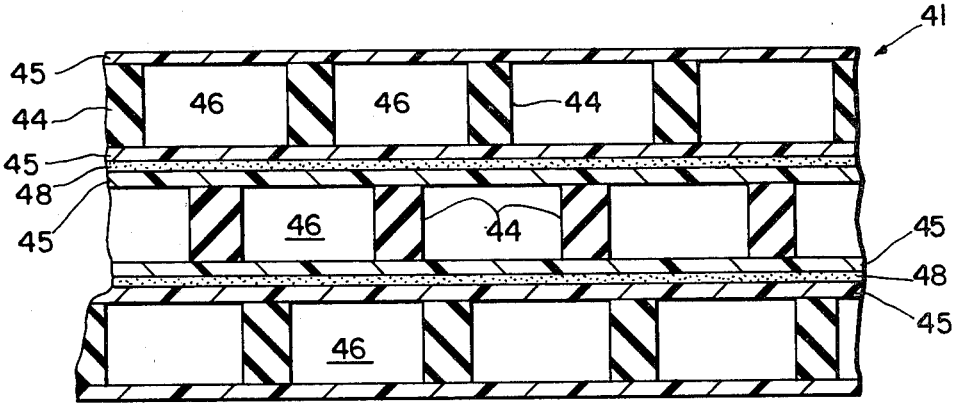
FIG. 5 is a sectional view of FIG. 4, taken generally along line 5—5.
Figure 6:
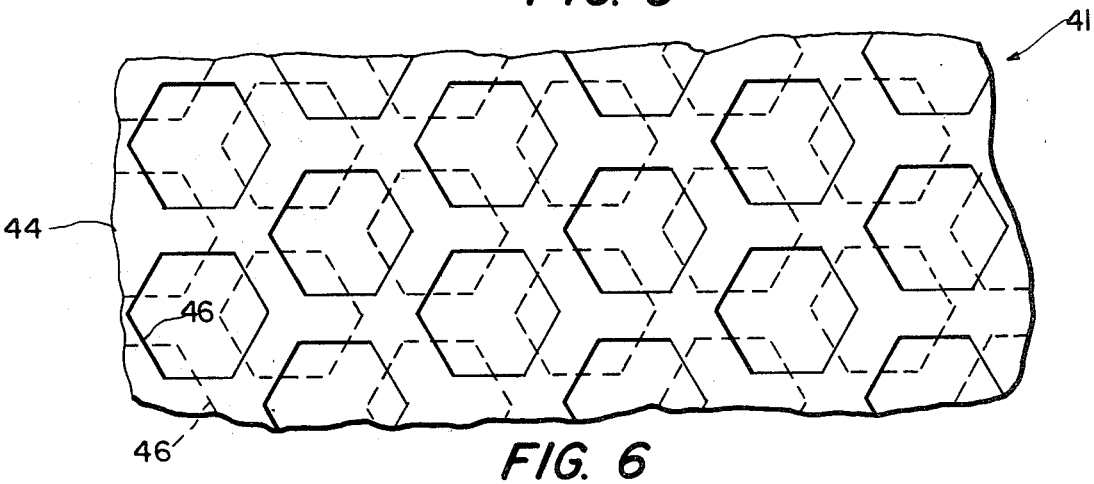
FIG. 6 is a plan view of another acoustic skirt baffle provided with hexagonal air cells.
Figure 7:
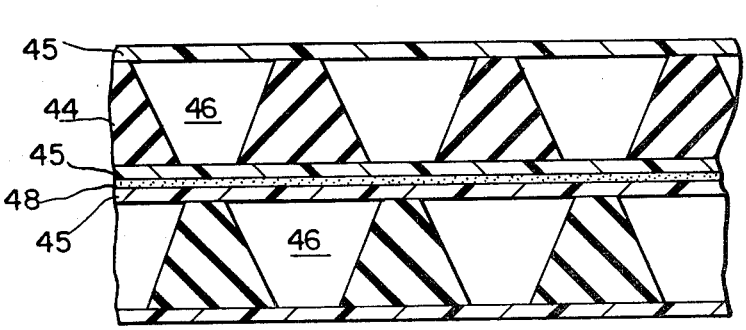
FIG. 7 is a sectional view of still another acoustic skirt baffle provided with conical air cells.

The skirt baffle 41, which is disposed between the conditioning module 21 and the hull 13 of the vessel, is used to reflect, attenuate and otherwise reduce the transmission of shipboard noise to the conditioning module 21. FIGS. 4 and 5 illustrate a preferred skirt baffle construction comprising compliant elastomeric layers 44 sandwiched between thin, rigid layers 45. In the preferred construction, a rigid layer 45 is bonded to the opposite faces of each elastomeric layer 44 to form a modular unit, wherein the modular units are subsequently bonded together with flexible epoxy glues or other flexible bonding agents not subject to degradation in seawater. The flexible epoxy glue enhances the shock resistance of the skirt baffle 41 by forming a compliant layer 48 between two adjacent rigid plates 45. The alternating arrangement of rigid and compliant layers, which inherently possess different density and impedance characteristics, convert the acoustic waves traveling through the skirt baffle into complex wave interference and reflecting patterns. By forming the rigid and viscoelastic layers of particular materials and predetermined dimensions, the skirt baffle 41 can be designed to optimize the insertion loss of particular ranges of acoustic frequencies.

The thin, rigid layers 45 are preferably formed of composite materials such as fiber-reinforced plastics (eg. fiberglass) and polycarbonates which are characteristically lightweight and possess high flexural strength. The compliant layers 44 are preferably formed of viscoelastic materials provided with a regular pattern of air cells 46 or chambers which reduce the effective modulus (E) of the elastomeric material and increase the resultant buoyancy of the viscoelastic layer 44. Examples of suitable viscoelastic materials generally include silicone rubbers, polyisoprene, polybutadiene—polyisoprene blends, and related elastomeric materials having low glass—transition temperatures and low densities.

As shown in FIGS. 4–7, the pattern of air cells 46 in adjacent compliant layers 44 are translated and/or offset from each other so that the load bearing walls of one compliant layer 44 overlap the open-cell regions of the adjoining compliant layer 44. For example, in the plan view of FIG. 4 the upper rigid plate 45 has been removed to expose the pattern of cylindrical air cells 46 in the uppermost compliant layer 44 and the pattern of air cells 46 in the lower adjoining layer 44 are shown in broken lines. This offset arrangement optimizes the acoustic compliance of the elastomeric layer 44 by permitting localized flexing of the rigid layers 45 while uniformly distributing the applied stresses throughout the acoustic baffle 41 to preclude localized flexural failure of the rigid layers 45. Other multilayered cell arrangements in the analogous field of crystalline chemistry include the hexagonal-close-packing (HCP), the face-centered-cubic (FCC), and the body-centered-cubic (BCC) lattice arrangements, wherein the air cells 46 in the elastomeric layers 44 represents the spheres of the packing systems.

Preferably, the air cells 46 are arranged in a pattern where there is uniform material thickness between the adjacent air cells to more evenly distribute the applied hydrostatic pressures and to prevent localized bulging of the elastomeric walls. Thus, in the baffle 41 of FIG. 4, small cylindrical air spaces 47 are provided between the larger cylindrical air cells 46 so that the wall thickness of the elastomeric layer 44 is essentially uniform. Further, in FIG. 6, the hexagonal air cells 46 are arranged so that there is a uniform thickness between adjacent air cells in the same layer. Furthermore, to achieve a uniform wall thickness for the skirt baffle 41 shown in FIG. 7, conical air cells can be interposed between the inverted air cells 46 in the elastomeric material 44.

For one skirt baffle construction of the type shown in FIGS. 4 and 5, the elastomeric layers 44 were formed about one-quarter inches thick, the rigid layers 45 were about one-thirty second inches thick, and the epoxy bond layers were about ten to twenty mils thick (wherein 1 mil-1/1000 inch). The large air cells 46 has a radius of about one inch and the smaller air spaces 47 had a radius of about one-quarter inch with a wall thickness of about one-quarter inches between the various air cells 46 and air spaces 47.

From a strictly mathematical point of view, a primary consideration in the design of a skirt baffle 41 is minimizing the characteristic impedance ($Z_{ch}$) of the elastomeric material 44 for a preselected hydrostatic pressure, where:

$$Z_{ch} = \sqrt{K/K_o} \cdot S_o \sqrt{E_o \rho}$$

In this formula K is the dynamic stiffness of the elastomeric material and K is a function of temperature and the incident acoustic frequency; $K_o$ is the static stiffness, as a function of the temperature; $S_o$ is the "solidity" of the material and $S_o$ is expressed as the percent of rubber in an average plan cross-section; $E_o$ is the static modulus of the material; and $\rho$ is the density of the elastomeric material 44. In general, the use of multiple, thin elastomeric layers 44 allows an increase in the shape factor of the baffle 41 and contributes to improved performance at the lower frequencies and at high hydrostatic pressures.

The outer layer 51 of the sonar array 15 contains a plurality of hydrophone units 53 and the outer layer 51 is bonded or otherwise connected to the exterior coverplate 22 of conditioning module 21 so that the outer layer 51 and module 21 are mounted on the hull 13 of the vessel as an integral unit. To allow the incident acoustic signals to reach the hydrophone units 53, the outer layer 51 should comprise a material which has an impedance substantially equivalent to the impedance of seawater. Examples of suitable materials include elastomers such as silicone rubber, polyurethane, butyl rubber, ehtylene-propylene rubber, as well as polymer blends such as neoprene (75%) and cis-4 polybutadiene (15%).

Obviously many modifications and variations of the present invention are possible in light of the above teachings. It is therefore to be understood that within the scope of the appended claims the invention may be practiced otherwise than as specifically described.

I claim:

1. An acoustic array for application to submerged hull surfaces comprises:

an acoustic baffle for attachment to the hull to reduce the transmission of shipboard noise, said acoustic baffle including layers of viscoelastic material disposed between layers of rigid material;

an acoustic conditioning module connected to said acoustic baffle for coherently reflecting incident acoustic signals so that the reflected acoustic signals reinforce the incident acoustic signals, said conditioning module including spaced coverplates, a plurality of spacer elements extending between said coverplates to form sealed chambers therebetween and a plurality of damping elements positioned in said chambers and connected to one of the coverplates; and an outer layer connected to said acoustic conditioning module, said outer layer contains a plurality of hydrophone units and said outer layer is formed of material having an impedance which approximates the impedance of seawater;

where said rigid layers are bonded to the opposite faces of the viscoelastic layers to form a plurality of modular units, and said modular units being bonded together with flexible bond layers so that a flexible bond layer is disposed between the rigid layers of the adjacent modular units; and wherein the viscoelastic layers are formed with a plurality of open cells arranged in a predetermined pattern with the pattern of open cells in adjacent viscoelastic layers being offset from each other so that the load bearing portions of one viscoelastic layer overlap the open cells of the adjoining viscoelastic layer.

2. The array according to claim 1, wherein the open cells are cylindrically shaped, and the viscoelastic layers further include air spaces symmetrically interposed between the open cells so that the wall thickness of the load bearing portions of the viscoelastic layers is substantially uniform.

3. The array according to claim 1, wherein the open cells are conically shaped.

4. The array according to claim 1, wherein the open cells are hexagonally shaped.

5. The array according to claim 1, wherein the characteristic impedance of the viscoelastic layer is equivalent to $\sqrt{K/K_o}.S_o\sqrt{E_o\rho}$, where K is the dynamic stiffness of the viscoelastic material, $K_o$ is the static stiffness of the viscoelastic material, $S_o$ is the solidity of the material, $E_o$ is the static modulus of the material, and $\rho$ is the density of the viscoelastic material.

6. The array according to claim 5, wherein each of said plurality of damping elements includes an inertial mass and an elastomeric damping layer having an acoustic impedance equivalent to $(Z_s(Z_s=iZ_r \tan h\ \gamma_r L_r))/(Z_r+iZ_s \tan h\ \gamma_r L_r)$; where $Z_s=i\omega m$, the impedance of said inertial mass, i is equivalent to $\sqrt{-1}$, $Z_r$ is the impedance of said elastomeric damping layer, $\gamma_r$ is the complex propagation constant for said elastomeric damping layer, $L_r$ is the thickness of said elastomeric damping layer $\omega$ is the angular incident frequency $2\pi f$, and m is the mass per unit area of said inertial mass layer.

7. The array according to claim 6, where the elastomeric damping layer has a modulus of elasticity which is equivalent to $16d^2f^2\rho$, where d is the layer thickness of the elastomeric damping layer, f is the center frequency of incident acoustic signals of a predetermined frequency range, and $\rho$ is the density of the elastomeric damping layer.

* * * * *